US005921028A

United States Patent [19]

Marocco

[11] Patent Number: 5,921,028

[45] Date of Patent: Jul. 13, 1999

[54] END CLOSURE FOR LOUVRE SHUTTER

[75] Inventor: Norbert Marocco, Woodbridge, Canada

[73] Assignee: Shade-O-Matic Ltd., Toronto, Canada

[21] Appl. No.: 09/080,188

[22] Filed: May 18, 1998

[51] Int. Cl.[6] ..... E06B 7/08

[52] U.S. Cl. ..... 49/403; 49/92.1

[58] Field of Search ..... 49/87.1, 92.1, 49/403, 74.1; 160/172 R, 173 R, 246

[56] References Cited

U.S. PATENT DOCUMENTS

| | | | |
|---|---|---|---|
| 3,110,936 | 11/1963 | Berard | 49/403 X |
| 5,001,864 | 3/1991 | Truscott | 49/403 |
| 5,191,735 | 3/1993 | Ross | 49/403 X |
| 5,303,507 | 4/1994 | Oille | 49/403 X |
| 5,566,738 | 10/1996 | Yadidya | 49/92.1 X |
| 5,778,598 | 7/1998 | Ohanesian | 49/403 X |

*Primary Examiner*—Jerry Redman

[57] ABSTRACT

A louvre, for use in a louvre shutter and having a generally hollow elongated aerofoil shape, defined by upper and under exterior walls, intermediate support walls between the upper and under exterior walls, for holding the shape of the upper and under exterior walls, an end closure member for each end having a body with a profile generally corresponding to the aerofoil shape defined by the upper and under exterior louvre walls, and a pivot axle extending from an outside surface for mounting the louvre rotatably, a plurality of frictional fingers formed on the inside surface formed of the body and located so as to inter-engage with portions of the support walls of the louvre. Also disclosed is a shutter comprised of such louvres, and having side frames between which such louvres are mounted in parallel spaced apart location. Also disclosed is a frictional braking system engaging at least one of the louvres and mounted in one of the side frames, to control movement of the louvres and hold them in a preset position.

15 Claims, 3 Drawing Sheets

END CLOSURE FOR LOUVRE SHUTTER

FIELD OF THE INVENTION

The invention relates to louvre shutters, such as are used in door and window openings, for providing decorative interior effects, and at the same time providing for either privacy or open viewing, through the louvres.

In the past such louvre shutters have commonly been made of solid wood frames and the louvres have been of solid wood, being two or three inches wide.

BACKGROUND OF THE INVENTION

The louvres are usually arranged horizontally between two vertical side members or side frames. Usually the louvres can be adjusted opened or closed by means of a pull rod. The pull rod, in the past, has been located centrally of the louvres in most cases, although in some cases there have been instances where louvre pull rods have been located at one end or the other of the louvres, alongside one or other of the side frames.

Other forms of control for the shutter louvres have been used in the past such as ladder cords, similar to the Venetian blinds, and rack and pinion systems have also been used for connecting and controlling the louvres.

Present advances in construction involve the use of extruded plastic material for the manufacture of the side frames and top and bottom frames. Also, the louvres themselves are extruded. For this purpose they are formed of hollow construction, having a generally aerofoil shape. The interior is hollow, and is formed with a variety of different interior formations, so as to maintain the aerofoil shape of the extruded louvre along its length.

Manufacturing practice with this type of construction involves cutting the louvres to length, and then fitting end closures in either end of the louvre. The end closures are usually injection moulded plastic items, and they incorporate integral fingers fitting within the louvre blade, usually enabling the end fixture to be glued in place, and they also incorporate outwardly extending axles or pivots on which the louvre blades can then be pivotally mounted between the two side members of the frame.

However, experience has shown that the use of adhesives is a time consuming messy operation, and that the need to employ special high-tech adhesives involves a very considerable cost in the manufacturing of the louvres. This is particularly true when it is considered that there may be eight or ten louvre blades, each having end fixtures at each end, meaning that up to twenty end fixtures have to be manually glued into position to make one louvre shutter. Also some end closures have tended to distort the profile of the louvre, and impair the appearance.

Accordingly, it is clearly desirable if it can be achieved, to avoid the use of adhesives, so as to both speed up production and also reduce manufacturing costs.

Another problem in the design of such shutters in the past, has been that the shutter blades were relatively heavy. Consequently, even though the individual house owner might want to have the slats open, due to the weight of the pull rod, they would gradually tend to swing closed. Another problem was that it is desirable for the sake of appearance that all of the slats shall be tilted at the same angle. Again, in the past, this was not always possible and there was a tendency for some slats to be looser and some tighter, and the looser slats might twist out of position due to air movement and the light.

BRIEF SUMMARY OF THE INVENTION

With a view to overcoming the various disadvantages noted above, the invention comprises a louvre, for use in a louvre shutter and comprising an extended louvre body of generally elongated aerofoil shape, defined by upper and under exterior walls, a plurality of intermediate support walls extending between said upper and under exterior walls, along the length of the hollow space defined between the upper and under exterior walls, for holding the shape of the upper and under exterior walls, and an end closure member for each end of said louvre body, said end closure defining a body portion having a profile generally corresponding to the aerofoil shape defined by said upper and under exterior louvre walls, and defining an inside and an outside surface, an axle pivot extending from said outside surface of said body member, for mounting said louvre rotatably, a plurality of frictional fingers formed on said inside surface of said body, said frictional fingers being formed and located so as to interengage with portions of said support walls of said louvre body.

It is a further objective of the invention to provide such closure members for each end of such a louvre, so that the closure members may simply be frictionally pushed into engagement at each end of the louvre without the use of adhesive.

The invention also envisages the use of spacer members formed on said inside surface of said body, extending into the corners of said interior of said louvre, for holding the shape thereof.

The invention also includes a louvre shutter made up of such louvres.

Another aspect of the invention is the provision of a friction brake device, engaging at least one of the louvres, and providing a frictional stop, holding all of the louvres in a predetermined preset position, after they have been moved by the home owner.

The various features of novelty which characterize the invention are pointed out with more particularity in the claims annexed to and forming a part of this disclosure. For a better understanding of the invention, its operating advantages and specific objects attained by its use, reference should be made to the accompanying drawings and descriptive matter in which there are illustrated and described preferred embodiments of the invention.

IN THE DRAWINGS

DESCRIPTION OF A SPECIFIC EMBODIMENT

Figure 1:
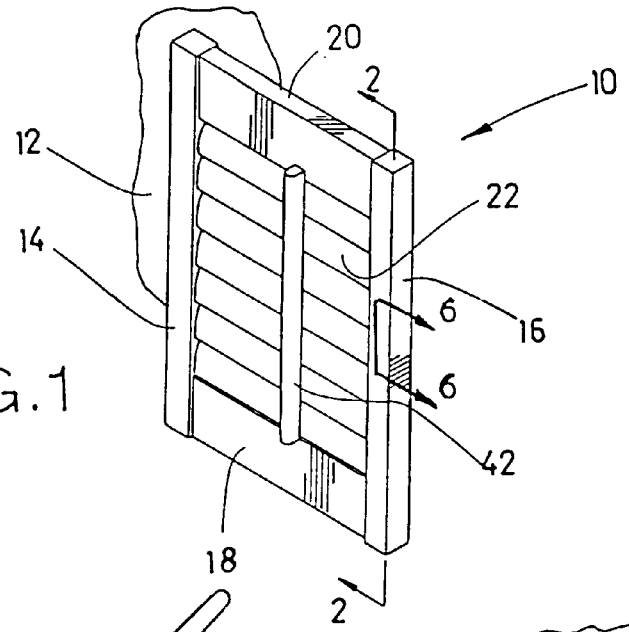
FIG. 1 is a perspective illustration, partially cut away, of louvre shutter illustrating aspects of the invention.

Referring first of all to FIG. 1, it will be seen that the invention is there illustrated in the form of a single louvre shutter indicated generally as 10. In many cases such louvre shutters will be arranged in multiples, so that there are pairs of such louvre shutters on either side of for example, a french door or the like, or a window opening. They are normally hinged together by means not shown, so that they may be swung away to the side of the opening and back again as desired.

The frame work around the opening is indicated generally as 12 that being merely an indication of a typical moulding around a window or door opening, although there may be many other forms of such mouldings defining window or door openings.

The louvre shutter 10 consists of two side frame members 14 and 16, a bottom member 18 and a top member 20. The dimensions between the top and bottom members may vary somewhat depending upon the dimensions of the window or door opening to which the louvre shutter is fitted. This may vary the vertical spacing between the lower and upper members which will have significant effects on the design and manufacture of the louvre shutter as will be apparent from the following description.

One form of such a louvre shutter is shown in U.S. Pat. No. 5,469,658, inventors Michele Digianni and Norbert Marocco, and assigned to Shade-O-Matic Limited.

Other forms of louvre shutters are shown for example in U.S. Pat. No. 4,887,391, inventor Kenneth Briggs, assigned to Rushman Draperies Inc.

It will be seen that in the one example the louvres are rotated between open and closed positions by means of a rack and pinion system, and in the other patent, simply by means of a pull rod connected to all of the louvres. Such pull rods may be connected down the centre of the louvres in many cases, or alongside one end of the louvres, the object being to simply open and close the louvres in unison, by a single hand control, and to control their positions so that the appearance of the louvre shutter is regular and even and aesthetic whether opened or closed or partially open.

In the case of the present invention, there is illustrated in FIG. 1 a plurality of louvres indicated as 22-22, which are mounted transversely between the side members 14 and 16, and parallel with one another.

At each end of the louvres 22, there is an end cap or closure member 24 (FIG. 2), the details of which will be explained below.

The details for operating the louvres, whether by rack and pinion or by pull rod or any other means is omitted for the sake of clarity, since it will be appreciated that the invention is equally applicable to all such various operating systems.

Figure 2A:
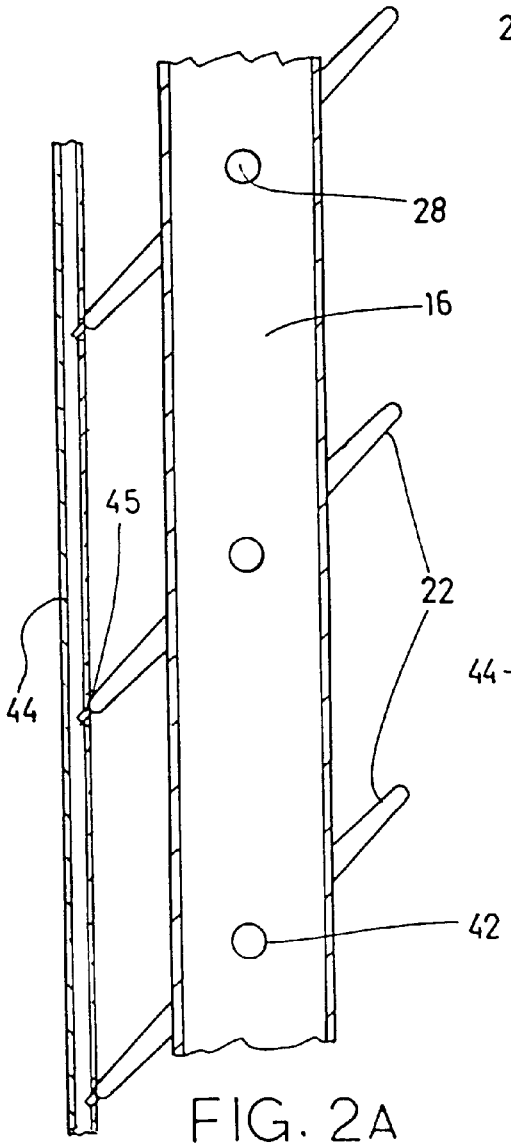
FIG. 2A is a section along the line 2—2 of FIG. 1.
Figure 2B:
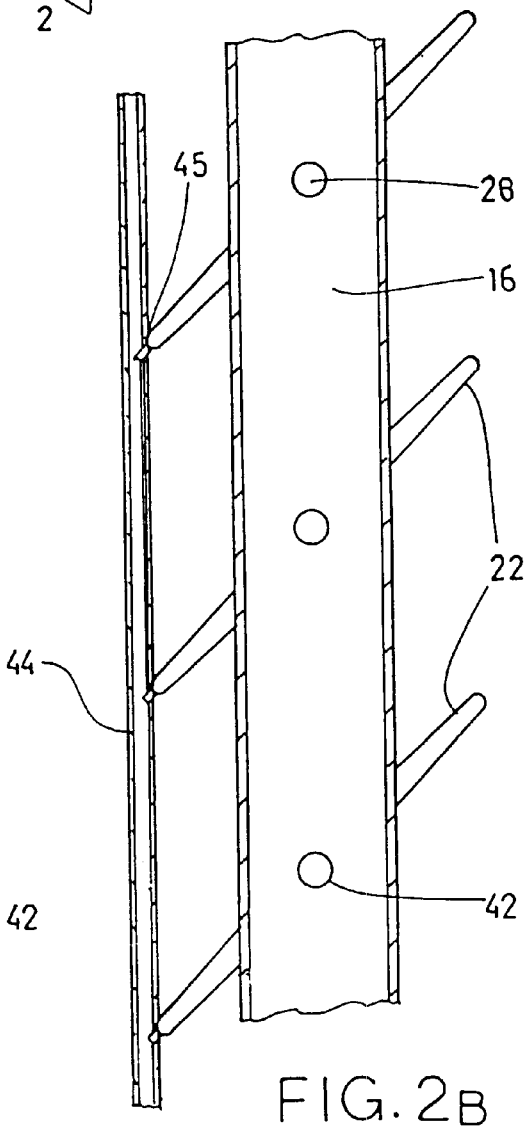
FIG. 2B is a section of modified blind corresponding to 2A.
Figure 3:
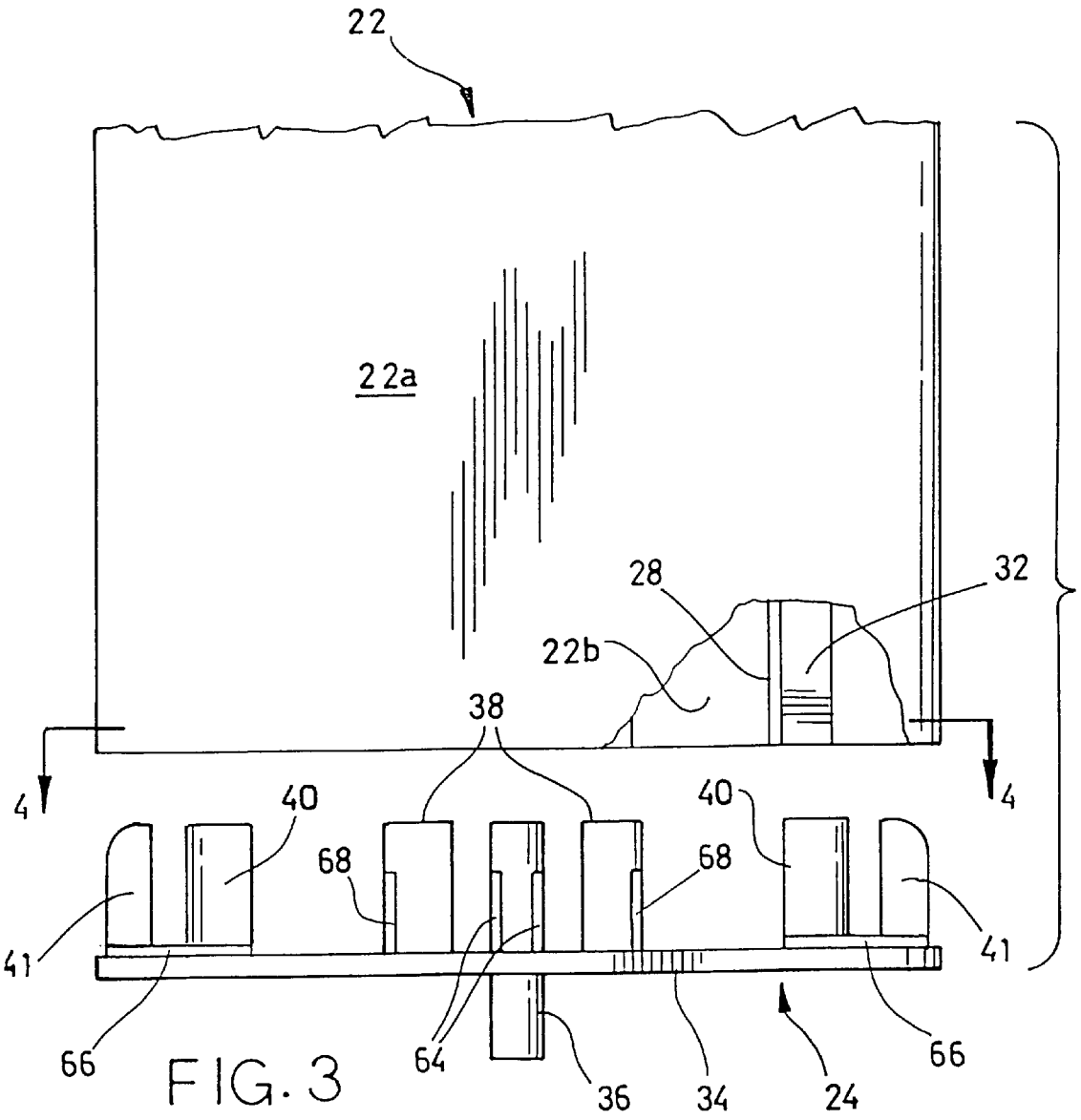
FIG. 3 is an exploded plan view of one end of one louvre showing a louvre closure member about to be inserted therein.
Figure 4:
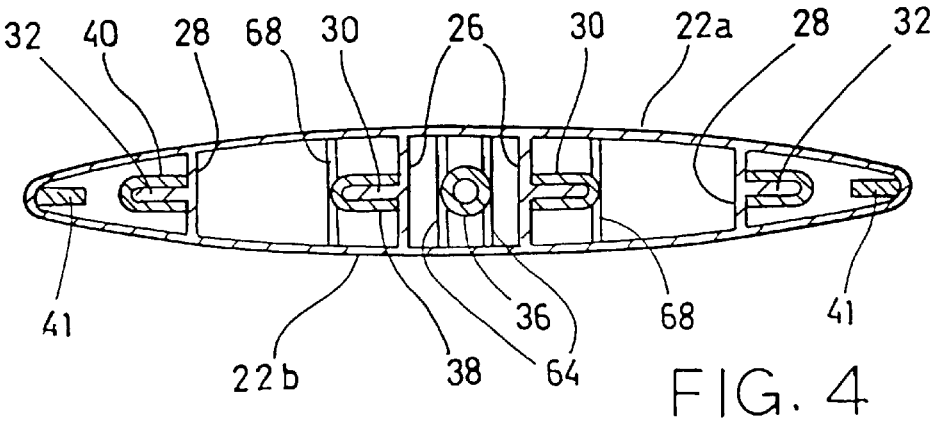
FIG. 4 is a section along the line 4—4 of FIG. 3, showing the louvre and the end closure inserted in position.

Referring now to FIGS. 2, 3 and 4, the construction of each louvre and the end cap members is shown in more detail.

Figure 5:
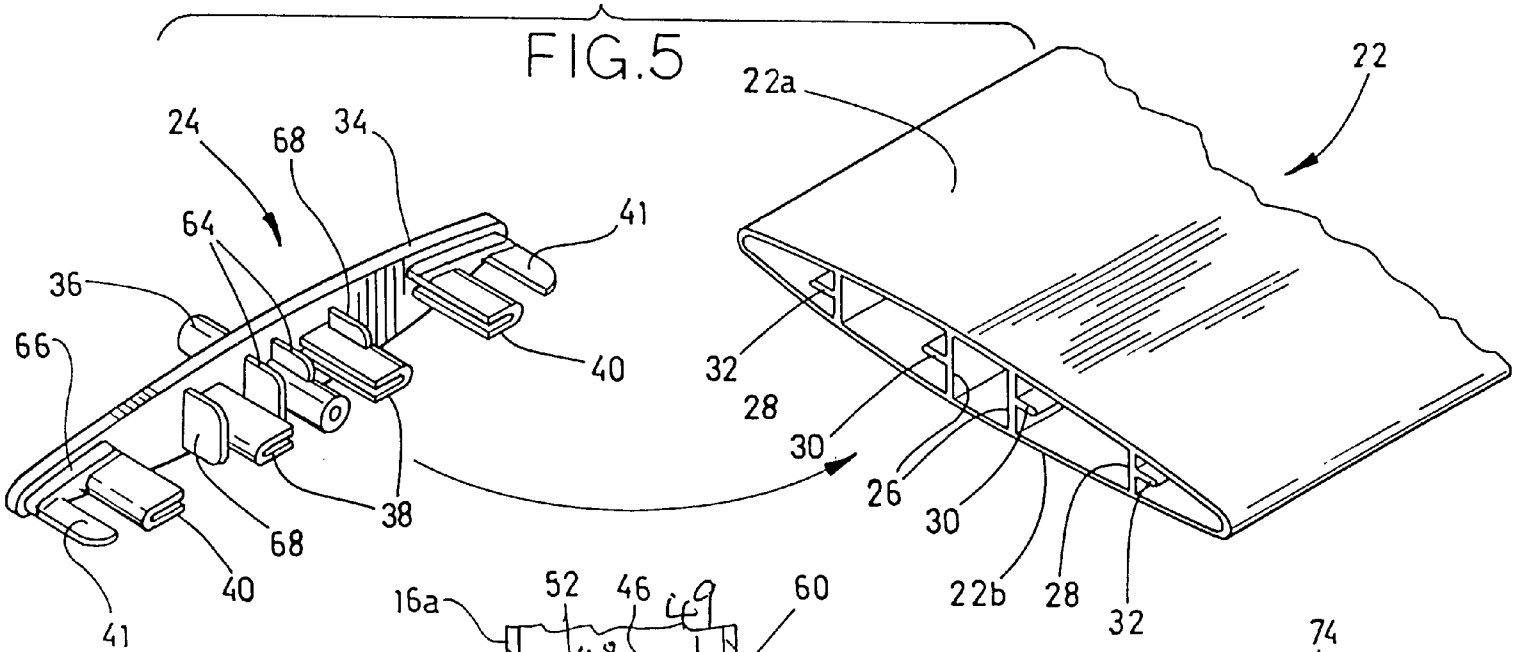
FIG. 5 is an exploded perspective illustration of one end of a louvre, and showing the closure member also in perspective.

As explained above each louvre is represented by the reference numeral 22. It consists of a louvre body having upper and lower outer walls 22A and 22B, which are formed integrally by plastics extrusion, into a generally aerofoil shape as shown (FIGS. 4 and 5).

It will of course be appreciated that the reference to the walls 22A and 22B as being upper and under walls is simply for the sake of convenience in this description, and has no limitation. The louvres may be used either way up, as is readily apparent.

Within the interior of the louvre body enclosed between walls 22A and 22B, there are a plurality of transverse spacer walls. In this case there are four such spacer walls but it will be appreciated that this is simply a matter of design choice. There could be more, or in some cases less. In this case there are two central spaced apart transverse walls 26-26, and two spaced apart edge transverse walls 28-28. The transverse walls 26 and 28 extend the full length of the interior of the louvre body and assist in holding its profile, so as to maintain a quality appearance without sagging or warping.

Formed on the sides of walls 26 and 28, are friction fins 30 and 32. The fins are simply blade like members again extending the full length of the louvre body, and lie in a central plane intersecting the space between the upper and lower walls 22A and 22B. For the purposes of this description the fins 30 and 32 are deemed integral parts of their respective support walls 26 and 28.

The end closure 24 will be seen to comprise a main body 34, which is of generally elongated flattened oval in profile, corresponding to the profile defined by the upper and lower walls 22A and 22B of the louvre body.

The main body 34 defines an exterior surface, on which is mounted a pivot axle 36, and defines an interior surface on which are mounted a plurality of friction grips 38 and 40 and end abutments 41. The friction grips 38 and 40 are of generally U-shaped construction, and define an interior spacing which is adapted to make a snug friction fit with a respective one of fins 30 and 32.

In this way, when the end closure 24 is engaged with the open end of a louvre body, the friction grippers 38 and 40 will engage the fins 30 and 32, and are thus connected to the transverse support walls 26 and 28, and as the closure 24 is forced onto the end of the louvre body, the friction grippers 38 and 40 will bind on the fins 30 and 32, and hold the end closure 24 securely in position. The end abutments 41 engage the insides of walls 22A and 22B and help in holding the shape of the walls 22A–22B.

It will of course be appreciated that since there is an end closure at each end of each louvre 22, and that since the louvres themselves are pivotally mounted by axles 36 between the side members 14 and 16 of the louvre shutter in axle holes 42, there is very little endwise tension attempting to separate the end closures from the louvres. Consequently, the friction grip afforded by the grippers 38 and 40 provides an efficient and secure means of holding the end closures 24 in position.

The side members 14 and 16 of the frame are of hollow rectangular extruded construction, such as shown in U.S. Pat. No. 5,469,658 referred to above. The axle holes 42 are simply drilled on the inside face walls of the side members 14 and 16 facing one another (FIG. 1).

The use of adhesives and the like is thus avoided.

At the same time it will be appreciated that since the friction grippers 38 and 40 grip fins 30 and 32 which are arranged more or less along the median of the space between the walls 22A and 22B, the friction grippers do not themselves impose any stresses on the walls 22A and 22B tending to widen them apart. Any such widening stresses on a thermoplastic material such as the louvre could in time tend to cause the louvre to open up, and loose its shape, and the end closures might come loose.

While the louvres according to the invention may be used to make a variety of different louvre shutters of different designs, some of which may incorporate rack and pinion controls for the louvres, and others may incorporate centre pull rods, for the purpose of simplicity in the present description, a centre pull rod indicated as 44 is provided. The pull rod 44 is rotatably coupled to each of the louvres by means 45. In this way operation of the pull rod 44 will either close or open the louvres as desired.

However the invention is not restricted solely to the showing of a pull rod, or a pull rod to one side, but envisages any of the various forms of louvre controls, including rack and pinion controls and cords such are known in the art.

As mentioned above, as the louvres are worked to and fro, over time, they may tend to loosen up in their holes 42 in the side frames 14 and 16, and there may be a tendency for the louvres to swing closed, when it is desired for them to stay open.

Figure 6:
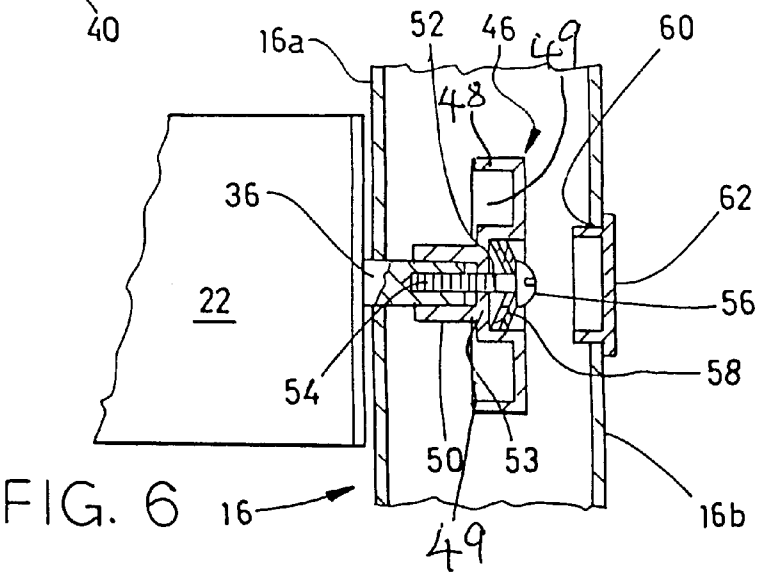
FIG. 6 is a sectional illustration along the line 6—6 of FIG. 1 illustrating a frictional brake feature of the invention for securing the louvres against unintended movement.

In order to overcome these problems, a friction brake is incorporated in one of the side frames, as shown in FIGS. 1 and 6.

The brake assembly is indicated generally as 46 and comprises generally rectangular thermoplastic member 48, having side walls 49 which are sized to make a snug sliding fit between the side walls of the side frame member 16, (FIG. 6). Member 48 has a bore 50, to receive the free end of axle 36, and a larger diameter well 52, connecting with bore 50. Axle 36 has a screw receiving central recess 54, and a screw 56 passes through well 52 into recess 54. Friction steel washers 58 may be used on screw 56, to provide a friction resistance within well 52, which can be adjusted. A registering hole 60 is formed in the side wall 16*b* of frame 16, for giving access to screw 58. A closure cap 62 is provided to close-off opening 60 and provide a neat appearance.

It will thus be understood that by tightening up the screw 56, the axle 36 will be drawn snugly into the bore 50, and the washer 58 would be compressed between the screw head and the well 52. Side walls 49 of member 46 engage the opposite side walls of side frame 16 and prevent rotation of member 46. This will provide a friction braking action, between the axle 36 and screw 56 and washer 58 in well 52 controlling the movement of the louvre 22. Since all of the louvres 22 are connected together by a pull rod or some other means, then all of the louvres 22 will be held in whatever position they are set by the user.

In order to still further improve the holding of the end member 24 in the louvres 22, and also to further assist in holding the shape and profile of the louvres 22, centre guide members 64, may be formed on either side of the hub 50, and abutments 41 may be surrounded by enlarged generally triangular base formations 66. In addition, spacer walls 68 may be moulded integrally with the grippers 38. The wall 64 and spacers 68 are formed in such a way that they extend from top to bottom within the space defined between the two walls 22A, 22B of the louvre 22 so as to hold the shape of the louvre when the end members 24 are pressed into position. The abutments 41 are formed so as to contact the insides of the junctions between the walls 22A, 22B of the louvre 22 so as to again hold the shape (see FIG. 4).

Figure 7:
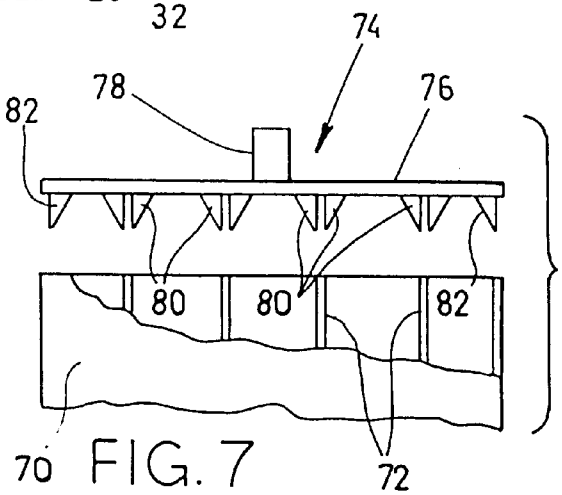
FIG. 7 is an exploded view of an alternate embodiment.

In spite of all of these considerations, there may be some cases where it may be desirable to simply make the end members and louvres as shown in FIG. 7. In this example, the louvres are shown as 70, being of hollow construction similar to the louvre 22. They are simply formed with a plurality of vertical spacer ribs 72 spaced apart from one another.

The end member 74 is formed of a closure wall 76, and a central hub 78. The plurality of pairs of finger grippers 80 are provided to grip the wall 72, and end spacers 82 are formed at each end of the wall 76 to fit snugly into the ends of the hollow louvre, so as to hold its shapes.

This construction may have some advantages in certain circumstances.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A louvre for a shutter and comprising;

a hollow louvre body of generally elongated aerofoil shape, defined by upper and under exterior louvre walls and having a hollow interior;

a plurality of intermediate support walls extending transversely from said upper walls to said under walls, along the length of the hollow interior defined between the upper and under exterior walls, for holding the shape of the upper and under exterior walls by preventing spreading of said upper and under walls;

an end closure member for each end of said louvre body, said end closure member defining in turn a body portion having a profile generally corresponding to the aerofoil shape defined by said upper and under exterior louvre walls, and defining an inside and an outside surface;

a pivot axle extending from said outside surface of each said body portion at each end of said louvre body, for mounting said louvre body rotatably; and a plurality of frictional members formed on said inside surface of said body portion, said frictional members being formed and located so as to inter-engage with portions of said intermediate support walls extending from said upper walls to said portions of said under walls of said louvre body for retaining said end closure members in said ends of said louvres by frictional engagement between said frictional members and said support walls without spreading said upper and under walls.

2. A louvre, as claimed in claim 1 wherein said end closure members are frictionally secured in engagement at each end of the louvre body without the use of adhesive.

3. A louvre as claimed in claim 1 including spacer members formed on said inside surface of said body portion and extending into the corners of said interior of said hollow louvre body, for holding the shape thereof.

4. A louvre as claimed in claim 1 and including;

a plurality of intermediate frictional fins formed within said inner and outer walls, said frictional members being interengageable with said fins, and wherein said frictional fins are formed on said intermediate support walls, and extend substantially normal thereto.

5. A louvre as claimed in claim 4 and wherein said frictional members comprise generally U-shaped frictional grippers, oriented and dimensioned to register with said frictional fins, and to make a good snug push fit with said fins thereby holding said end closure members in position in said louvre body.

6. A louvre as claimed in claim 1 and wherein said intermediate support walls extend between said upper and under exterior louvre walls, and wherein said frictional members are formed on said inside surface of said body portion, and define slots therebetween, said slots being adapted to fit around at least some of said intermediate support walls.

7. A shutter comprising;

pairs of opposed side frames, said side frames being of hollow construction, and openings in said side frames in spaced apart location along said side frames;

a plurality of hollow louvre bodies of generally elongated aerofoil shape, defined by upper and under exterior louvre walls and having a hollow interior;

a plurality of intermediate support walls extending from said upper louvre walls to said under louvre walls, along the length of the hollow interior defined between the upper and under louvre walls, for holding the shape of the upper and under walls by preventing spreading of said upper and under walls;

an end closure member for each end of each said louvre body, said end closure member defining in turn a body portion having a profile generally corresponding to the aerofoil shape defined by said upper and under exterior louvre walls, and defining an inside and an outside surface;

a pivot axle extending from said outside surface of each said body portion at each end of said louvre body, for mounting said louvre body rotatably in said openings in said side frames; and a plurality of frictional members formed on said inside surface of said body portion, said frictional members being formed and located so as to inter-engage with portions of said support walls extending from said upper walls to said under walls of said louvre body and retaining said body portion in said end of said louvre by frictional engagement between said frictional members and said portions of said support walls.

8. A shutter as claimed in claim 7 and including frictional brake means located within at least one of said side frames, and engaging at least one of said pivot axles, said frictional brake means applying a frictional braking action to said pivot axle, whereby to control movement of said louvres, and hold them in a desired preset position.

9. A shutter as claimed in claim 8 and wherein said brake means at least comprises a generally rectangular member slidably and non-rotatably received in a said side frame, a bore in said member to receive said pivot axle therein, a well communicating with said bore, for receiving a securing screw, said securing screw being passed through said well into the end of said pivot axle, thereby holding said pivot axle in said bore.

10. A shutter as claimed in claim 9 and including friction washer means mounted on said screw and engaging said member in said well, to apply a frictional braking force, and, registering opening means in a further side wall of said side frame registering with said screw, for adjusting of said screw, and a closure cap for said further opening.

11. A louvre for a shutter and comprising;

a hollow louvre body of generally elongated aerofoil shape, defined by upper and under exterior louvre walls and having a hollow interior;

a plurality of intermediate support walls extending between said upper and under exterior louvre walls, along the length of the hollow interior defined between the upper and under exterior walls, for holding the shape of the upper and under exterior walls;

an end closure member for each end of said louvre body, said end closure member defining in turn a body portion having a profile generally corresponding to the aerofoil shape defined by said upper and under exterior louvre walls, and defining an inside and an outside surface;

a pivot axle extending from said outside surface of each said body portion at each end of said louvre body, for mounting said louvre body rotatably;

a plurality of intermediate frictional fins formed within said inner and outer walls and, a plurality of frictional members formed on said inside surface of said body portion, said frictional members being formed and located so as to inter-engage with said frictional fins.

12. A louvre as claimed in claim 11 and wherein said frictional members comprise generally U-shaped frictional grippers, oriented and dimensioned to register with said frictional fins, and to make a good snug push fit with said fins thereby holding said end closure members in position in said louvre body.

13. A shutter comprising;

pairs of opposed side frames, said side frames being of hollow construction, and openings in said side frames in spaced apart location along said side frames;

a plurality of hollow louvre bodies of generally elongated aerofoil shape, defined by upper and under exterior louvre walls and having a hollow interior;

a plurality of intermediate support walls extending from said upper walls to said under louvre walls, along the length of the hollow interior defined between the upper and under louvre walls;

an end closure member for each end of each said louvre body, said end closure member defining in turn a body portion having a profile generally corresponding to the aerofoil shape defined by said upper and under exterior louvre walls, and defining an inside and an outside surface;

a pivot axle extending from said outside surface of each said body portion at each end of said louvre body, for mounting said louvre body rotatably in said openings in said side frames; and, a plurality of frictional members formed on said inside surface of said body portion, said frictional members being formed and located so as to inter-engage with portions of said support walls extending from said upper walls to said under walls of said louvre body and retaining said body portion in said end of said louvre by frictional engagement between said frictional members and said support walls, frictional brake means located within at least one of said side frames, and engaging at least one of said pivot axles, said frictional brake means applying a frictional braking action to said pivot axle, whereby to control movement of said louvres, and hold them in a desired preset position.

14. A shutter as claimed in claim 13 and wherein said brake means at least comprises a generally rectangular member slidably and non-rotatably received in a said side frame, a bore in said member to receive said pivot axle therein, a well communicating with said bore, for receiving a securing screw, said securing screw being passed through said well into the end of said pivot axle, thereby holding said pivot axle in said bore.

15. A shutter as claimed in claim 14 and including friction washer means mounted on said screw and engaging said member in said well, to apply a frictional braking force, and, registering opening means in a further side wall of said side frame registering with said screw, for adjusting of said screw, and a closure cap for said further opening.

* * * * *